US006105500A

United States Patent [19]

Bhambra et al.

[11] Patent Number: 6,105,500

[45] Date of Patent: Aug. 22, 2000

[54] HYDROPHILIZED SUPPORT FOR PLANOGRAPHIC PRINTING PLATES AND ITS PREPARATION

[75] Inventors: Harjit Singh Bhambra, Leeds; Robert Michael Organ, Oxfordshire, both of United Kingdom

[73] Assignee: Kodak Polychrome Graphics LLC, Norwalk, Conn.

[21] Appl. No.: 09/077,181

[22] PCT Filed: Nov. 21, 1996

[86] PCT No.: PCT/GB96/02883

§ 371 Date: Oct. 19, 1998

§ 102(e) Date: Oct. 19, 1998

[87] PCT Pub. No.: WO97/19819

PCT Pub. Date: Jun. 5, 1997

[30] Foreign Application Priority Data

Nov. 24, 1995 [GB] United Kingdom ..... 9524134
Mar. 11, 1996 [GB] United Kingdom ..... 9605066

[51] Int. Cl.[7] ..... B41N 3/03

[52] U.S. Cl. ..... 101/455; 101/459; 427/205

[58] Field of Search ..... 101/453, 454, 101/455, 456, 459, 458, 463.1; 427/203, 205; 205/201, 203

[56] References Cited

U.S. PATENT DOCUMENTS

| | | | |
|---|---|---|---|
| 2,714,066 | 7/1955 | Jewett et al. | 101/456 |
| 3,181,461 | 5/1965 | Fromson | 101/456 |
| 3,470,013 | 9/1969 | Wagner | 101/453 |
| 3,640,221 | 2/1972 | Wyke | 101/453 |
| 3,963,594 | 6/1976 | Brasko | 205/658 |
| 3,971,660 | 7/1976 | Staehle | 101/455 |
| 4,052,275 | 10/1977 | Gumbinner et al. | 428/687 |
| 4,072,589 | 2/1978 | Golda et al. | 205/658 |
| 4,131,518 | 12/1978 | Fromson | 101/459 |
| 4,268,609 | 5/1981 | Shiba et al. | 430/271.1 |
| 4,330,605 | 5/1982 | Boston | 430/14 |
| 4,420,549 | 12/1983 | Cadwell | 430/158 |
| 4,457,971 | 7/1984 | Cadwell et al. | 428/323 |
| 4,507,383 | 3/1985 | Tsuruta et al. | 430/302 |
| 4,542,089 | 9/1985 | Cadwell et al. | 430/276 |
| 4,567,131 | 1/1986 | Watkiss | 430/309 |
| 5,171,650 | 12/1992 | Ellis et al. | 430/20 |
| 5,462,833 | 10/1995 | Hauquier | 430/159 |
| 5,881,645 | 3/1999 | Lenney et al. | 101/463.1 |

FOREIGN PATENT DOCUMENTS

| | | | |
|---|---|---|---|
| 0 028 137 | 5/1981 | European Pat. Off. . | |
| 0 110 417 | 6/1984 | European Pat. Off. . | |
| 0 565 006 A2 | 10/1993 | European Pat. Off. . | |
| 0 619 524 A1 | 10/1994 | European Pat. Off. . | |
| 0 619 525 A1 | 10/1994 | European Pat. Off. . | |
| 0 620 502 A1 | 10/1994 | European Pat. Off. . | |
| 0 653 685 A1 | 5/1995 | European Pat. Off. . | |
| 112615 | 12/1898 | Germany . | |
| 1118009 | 3/1957 | Germany . | |
| 31 44 657 A1 | 2/1982 | Germany . | |
| MI94A0448 | 10/1994 | Italy . | |
| 84994 | 7/1981 | Japan | 101/455 |
| 59-214651 | 4/1984 | Japan . | |
| 61-123594 | 11/1986 | Japan . | |
| 63-268543 | 11/1988 | Japan . | |
| 63-268642 | 11/1988 | Japan . | |
| 2-003956 | 1/1990 | Japan . | |
| 3-207608 | 9/1991 | Japan . | |
| 956376 | 4/1964 | United Kingdom . | |
| 1141556 | 1/1969 | United Kingdom . | |
| 1196886 | 7/1970 | United Kingdom . | |
| 1439127 | 6/1976 | United Kingdom . | |
| 2 031 442 | 4/1980 | United Kingdom . | |
| 1592281 | 7/1981 | United Kingdom . | |
| 2 069 164 | 8/1981 | United Kingdom . | |
| 2 080 964 | 2/1982 | United Kingdom . | |
| 2 109 573 | 6/1983 | United Kingdom . | |
| 2 166 255 | 4/1986 | United Kingdom . | |
| 2 222 553 | 3/1990 | United Kingdom . | |
| 2 277 282 | 10/1994 | United Kingdom . | |
| WO 89/01871 | 3/1989 | WIPO . | |
| WO 91/12140 | 8/1991 | WIPO . | |
| WO 94/05507 | 3/1994 | WIPO . | |
| WO 97/19819 | 6/1997 | WIPO . | |
| WO 98/22853 | 5/1998 | WIPO . | |

OTHER PUBLICATIONS

"Hawley's Condensed Chemical Dictionary," 10th ed., G.G. Hawley, Van Nostrand Reinhold, New York, 1987, pp. 1072–1073.

"Chemistry of the Elements," N.N. Greenwood and A. Earnshow, Pergamon Press, Oxford, 1985, pp. 396 & 398.

*Primary Examiner*—Stephen R. Funk
*Attorney, Agent, or Firm*—Ratner & Prestia

[57] ABSTRACT

A method for preparing a substrate for a planographic printing plate is disclosed. A liquid that contains water; a soluble alkali metal silicate, preferably sodium silicate; and a dispersed particulate material is coated on a substrate, preferably aluminum or an aluminum alloy, to produce a hydrophilic layer on the substrate. A layer of image material may be coated over the substrate to produce a planographic printing plate. In one embodiment the liquid contains a mixture of two particulate materials: alumina and titanium dioxide.

37 Claims, No Drawings

HYDROPHILIZED SUPPORT FOR PLANOGRAPHIC PRINTING PLATES AND ITS PREPARATION

FIELD OF THE INVENTION

This invention relates to planographic printing and provides a method of preparing a substrate for a planographic printing member, a substrate of a planographic printing member and a planographic printing member per se. The invention particularly, although not exclusively, relates to lithographic printing.

BACKGROUND OF THE INVENTION

Lithographic processes involve establishing image (printing) and non-image (non-printing) areas on a substrate, substantially on a common plane. When such processes are used in printing industries, non-image areas are generally hydrophilic and image areas are generally oleophillic. Consequently, oil based inks are repelled from the non-image areas after water has been applied to the substrate.

Image and non-image areas can be created by processes which include a step of exposing a layer of image material on the surface of the substrate to radiation. The exposure to radiation creates solubility differences in the image material corresponding to image and non-image areas. During development, the more soluble areas are removed, leaving a pattern on the substrate corresponding to the image.

Preparation of the substrate for receiving a layer of the image material must ensure that the image material bonds to the substrate. However, it must allow release of the soluble image material during development.

One of the most common substrates used in lithographic printing comprises an aluminum base layer which is treated to make it suitable for use. In general, the aluminum layer comprises high quality aluminium, for example 1050 alloy which is at least 99.5% pure. For preparation of a substrate, the aluminum is roughened, for example by electrograining, anodized and then conditioned by chemical means, for example by treatment with water, a solution of phosphate or silicate salt, or a polycarboxylic acid.

Lithographic printing plates which utilize electrograined and/or anodized and/or chemically conditioned aluminum are described in, for example, UK Patent Application No. 1 439 127, U.S. Pat. Nos. 3,181,461, 3,963,594, 4,052,275, 4,072,589, 4,131,518, European Patent Application No. 0 110 417 and Japanese Publication No. 20/3956.

One problem with the known processes is that they consume a significant amount of electrical energy in the electrograining and anodizing steps. Furthermore, these steps produce waste chemicals which must be disposed of. Additionally, the processes can generally only be run at relatively low speed.

Numerous solutions have been proposed for the above described problems; however, few such proposals have been used commercially.

For example, PCT Publication No. WO91/12140 discloses a lithographic plate of aluminum metal which carries an oxide layer derived from a zirconia sol.

U.S. Pat. No. 4,457,971 discloses a lithographic printing plate comprising an aluminum or aluminized substrate bearing a ceramic layer comprising non-metallic inorganic particles and a water resistant phase or phases of a dehydration product of at least one monobasic phosphate.

U.S. Pat. No. 4,420,549 discloses a lithographic printing plate comprising an aluminum or aluminized substrate bearing a ceramic coating comprising a polymeric form of aluminum phosphate or mixtures of aluminum phosphates wherein the coating is substantially free of particulate matter.

U.S. Pat. No. 4,542,089 discloses a process for preparing a photosensitive substrate comprising providing a hydrophilic ceramic on an aluminum substrate or aluminized surface of a substrate by applying a slurry of at least one monobasic phosphate and inorganic non-metallic particles on at least one surface of the aluminum or aluminized substrate and firing the slurry at a temperature of at least 230° for a time sufficiently long to ensure substantially complete dehydration of the ceramic layer to form a hydrophilic ceramic coating.

Italian Patent Application No. MI94 A000448 describes lithographic plates prepared by applying a colloidal mixture comprising fluorosilicate, silica, polyvinylidene fluoride and titanium dioxide to an aluminum support. Polymerization of the fluorosilicate is carried out at 225°–300° C. for 50–180 seconds.

One problem associated with the above described processes results from the relatively high temperature required to cure and/or polymerize the coating on the aluminum. High temperatures are found to anneal the aluminum support and reduce its tensile strength. Additionally, high temperatures may deform the plate and cause it to have a wavy structure. Both of these effects can be problematical when the plates are run on a printing press.

Another solution to the problem of electrograining and/or annealing is described in PCT Patent Application No. GB93/01910. The document discloses making a lithographic printing plate by plasma spraying $Al_2O_3$ powder onto aluminum alloy sheet.

As an alternative to aluminum, plastic materials, for example polyesters, may be used as supports. Again, there are numerous disclosures of surface coatings for such materials.

For example, U.S. Pat. No. 4,330,605 discloses a photolithographic receptor sheet capable of being imaged by a silver salt diffusion transfer process which comprises coating a polyethylene terephthalate film with a mixture of colloidal silica and dry silica powder.

EP 0 619 524, EP 0 619 525 and EP 0 620 502 also disclose various coatings for polyethylene terephthalate film.

SUMMARY OF THE INVENTION

It is an object of the present invention to address problems associated with known planographic printing plates, parts thereof and methods of their production.

According to the invention, there is provided a method of preparing a substrate for a planographic printing member including the step of forming a hydrophilic layer on a support by contacting the support with a liquid comprising a silicate solution in which particulate material is dispersed.

DETAILED DESCRIPTION OF THE INVENTION

Preferably, said planographic printing member is a printing plate.

Said silicate solution may comprise a solution of any soluble silicate including compounds often referred to as water glasses, metasilicates, orthosilicates and sesquisilicates. Said silicate solution may comprise a solution of a modified silicate for example a borosilicate or phosphosilicate.

Said silicate solution may comprise one or more, preferably only one, metal or non-metal silicate. A metal silicate may be an alkali metal silicate. A non-metal silicate may be quaternary ammonium silicate.

Said silicate solution may be formed from silicate wherein the ratio of the number of moles of Si species, for example $SiO_2$, to the number of moles of cationic, for example metal species is in the range 0.25 to 10, preferably in the range 0.25 to about 6, more preferably in the range 0.5 to 4.

Said silicate is preferably alkali metal silicate. In this case, the ratio of the number of moles of $SiO_2$ to the number of moles of $M_2O$ in said silicate, where M represents an alkali metal may be at least 0.25, suitably at least 0.5, preferably at least 1, more preferably at least 1.5. Especially preferred is the case wherein said ratio is at least 2.5. Said ratio may be less than 6, preferably less than 5 and more preferably less than 4.

Preferred alkali metal silicates include lithium, sodium and potassium silicates, with lithium and/or sodium silicate being especially preferred. A silicate solution comprising only sodium silicate is most preferred.

Said liquid may comprise 2 to 30 wt % of silicate (e.g. dissolved sodium silicate solid), preferably 5 to 20 wt %, more preferably 8 to 16 wt %. The liquid may be prepared using 10 to 60 wt %, preferably 30 to 50 wt %, more preferably 35 to 45 wt % of a silicate solution which comprises 30 to 40 wt % silicate.

Said liquid may include 5 to 60 wt % of particulate material. Preferably, the liquid includes 10 to 50 wt %, more preferably 15 to 45 wt %, especially 20 to 40 wt % of particulate material.

The ratio of the weight of silicate to the weight of particulate material in the liquid is preferably in the range 0.1 to 2 and, more preferably, in the range 0.1 to 1. Especially preferred is the case wherein the ratio is in the range 0.2 to 0.6.

Said liquid may include more than 20 wt %, preferably more than 30 wt %, more preferably more than 40 wt %, especially more than 45 wt % water (including water included in said silicate solution). Said liquid may include less than 80 wt %, preferably less than 70 wt %, more preferably less than 65 wt %, especially less than about 60 wt % water.

Said particulate material may be an organic or an inorganic material. Organic particulate materials may be provided by latexes. Inorganic particulate materials may be selected from alumina, silica, silicon carbide, zinc sulphide, zirconia, barium sulphate, talcs, clays (e.g. kaolin), lithopone and titanium oxide.

Said particulate material may comprise a first material which may have a hardness of greater than 8 Modified Mohs (on a scale of 0 to 15), preferably greater than 9 and, more preferably, greater than 10 Modified Mohs.

Said first material may comprise generally spherical particles. Alternatively, said material may comprise flattened particles or platelets.

Said first material may have a mean particle size of at least 0.1 $\mu$m and preferably at least 0.5 $\mu$m.

Said first material may have a mean particle size of less than 45 $\mu$m, preferably less than 20 $\mu$m, more preferably less than 10 $\mu$m.

The particle size distribution for 95% of particles of the first material may be in the range 0.01 to 150 $\mu$m, preferably in the range 0.05 to 75 $\mu$m, more preferably in the range 0.05 to 30 $\mu$m.

Said first material preferably comprises an inorganic material. Said first material preferably comprises alumina which term includes $Al_2O_3$ and hydrates thereof, for example $Al_2O_3.3H_2O$. Preferably, said material is $Al_2O_3$.

Said particulate material in said liquid may include at least 20 wt %, preferably at least 30 wt % and, more preferably, at least 40 wt % of said first material. Said liquid may include 5 to 40 wt %, preferably 5 to 30 wt %, more preferably 7 to 25 wt %, especially 10 to 20 wt % of said first material.

Said particulate material may comprise a second material. Said second material may have a mean particle size of at least 0.001 $\mu$m, preferably at least 0.01 $\mu$m. Said second material may have a mean particle size of less than 10 $\mu$m, preferably less than 5 $\mu$m and, more preferably, less than 1 $\mu$m.

Mean particle sizes of said first and second materials suitably refer to the primary particle sizes of said materials.

Said particulate material in said liquid may include at least 20 wt %, preferably at least 30 wt % and, more preferably, at least 40 wt % of said second material. Said liquid may include 5 to 40 wt %, preferably 5 to 30 wt %, more preferably 7 to 25 wt %, especially 10 to 20 wt % of said second material.

Said second material is preferably a pigment. Said second material is preferably inorganic. Said second material is preferably titanium dioxide.

Said first and second materials preferably define a multimodal, for example a bimodal particle size distribution.

Where the liquid comprises a silicate and said particulate material comprises a first material and a second material as described, the ratio of the wt % of silicate (e.g. dissolved sodium silicate solid) to the wt % of said first material may be in the range 0.25 to 4, preferably in the range 0.5 to 1.5 and more preferably about 1. Similarly, the ratio of the wt % of silicate to the wt % of said second material may be in the range 0.25 to 4, preferably in the range 0.5 to 1.5 and more preferably about 1. The ratio of the wt % of first material to the wt % of second material may be in the range 0.5 to 2, preferably in the range 0.75 to 1.5, more preferably about 1 to 1.

Said particulate material may include a third material which is preferably adapted to lower the pH of the silicate solution. Said third material may be a colloid, suitably colloidal silica or an inorganic salt, suitably a phosphate, with aluminum phosphate being preferred. Where a third material is provided, preferably less than 30 wt % more preferably less than 20 wt %, especially less than 10 wt % of said particulate material is comprised by said third material.

The pH of said liquid may be greater than 9.0, is preferably greater than 9.5 and, more preferably, greater than 10.0. Especially preferred is the case wherein the pH is greater than 10.5. The pH is suitably controlled so that the silicate remains in solution and does not form a gel. A gel is generally formed when the pH of a silicate solution falls below pH9. The pH of said liquid is preferably less than 14, more preferably less than 13. It is understood that the pH of the liquid affects the adhesion of the hydrophilic layer on the support. It is found that the use of a liquid having a pH as described can lead to good adhesion.

The liquid may include other compounds for adjusting its properties. For example, the liquid may include one or more surfactants. Said liquid may include 0 to 1 wt % of surfactant (s). A suitable class of surfactants comprises anionic sulphates or sulphonates. The liquid may include viscosity builders for adjusting the viscosity of the liquid. Said liquid may include 0 to 10 wt %, preferably 0 to 5 wt % of viscosity builder(s). Also, the liquid may include dispersants for dispersing the inorganic particulate material throughout the liquid. Said liquid may include 0 to 2 wt % of dispersant(s). A suitable dispersant may be sodium hexametaphosphate.

Hydrophilic layers of planographic printing plates have been proposed which include organic polymers, for example thermoplastic polymers, for increasing the strength and/or hardness of the hydrophilic layers. Said liquid used in the method of the present invention preferably does not include a thermoplastic organic polymeric material, for example polyvinylidene fluoride or the like.

Said liquid may have a viscosity of less than 100 centipoise when measured at 20° C. and a shear rate of 200 $s^{-1}$ using a Mettler Rheomat 180 Viscometer incorporating a double gap measuring geometry. Preferably, said viscosity is less than 50 centipoise, more preferably less than 30 centipoise when measured as aforesaid. Especially preferred is the case wherein the viscosity is less than 20 centipoise.

Said liquid may be applied to said support by any suitable means which is preferably non-electrochemical.

Said liquid may be applied to both sides of said support in order to form a hydrophilic layer on both sides. A support with such a layer on both sides may be used to prepare a double-sided lithographic plate. Alternatively, if such a support is used for a single-sided plate, the side of the plate which does not carry an image layer may be protected by the hydrophilic layer. Said liquid is preferably applied to only one surface of said support.

Said liquid may be applied to said support to form a hydrophilic layer having an average thickness after drying, of less than 20 $\mu$m, preferably less than 10 $\mu$m and, more preferably, less than 5 $\mu$m. Especially preferred is the case wherein the average thickness is less than 3 $\mu$m.

The thickness of the hydrophilic layer may be greater than 0.1 $\mu$m, preferably greater than 0.3 $\mu$m and, more preferably, greater than 0.5 $\mu$m.

Said particulate material preferably defines formations in said hydrophilic layer which render said layer non-planar and which are arranged such that, when an image layer is applied over said hydrophilic layer, corresponding formations are defined on the surface of the image layer in a manner similar to that described in U.K. Patent Application No. GB 2 277 282, the contents of which are incorporated herein by reference.

The method preferably includes the steps of providing suitable conditions for the removal of water from the liquid after it has been applied to the support. Suitable conditions may involve passive or active removal of water and may comprise causing an air flow over the support and/or adjusting the humidity of air surrounding the support. Preferably, the method includes the step of arranging the support in a heated environment. The support may be placed in an environment so that its temperature does not exceed 230° C., preferably does not exceed 200° C. and, more preferably, does not exceed 175° C. Especially preferred is the case wherein the support temperature does not exceed 150° C.

The support may be arranged in the heated environment for less than 180 seconds, preferably less than 120 seconds and, more preferably, less than 100 seconds.

The support may comprise aluminum or an alloy. In this event, it is found to be advantageous to arrange the support in an environment wherein the temperature is less than 230° C. as described above since, at this temperature, annealing of the support is not significant and, therefore, the tensile strength of the support is maintained at an acceptable level. More particularly, the tensile strength of the aluminum, suitably measured using a Hounsfield tensile testing machine, may be at least 100 MPa, preferably at least 110 MPa and, more preferably, at least 120 MPa. Especially preferred is the case wherein the tensile strength is at least 140 MPa.

The liquid described above may also be advantageously applied to a plastic support, for example of polyester, in order to provide a hydrophilic layer thereon, in view of the fact that the liquid needs only to be cured at a relatively low temperature for a short time. As will be appreciated, curing at a relatively high temperature for long periods might otherwise detrimentally affect the properties of the plastic material.

The removal of water from the liquid applied to the support is believed to cause the silicate to polymerize and bind the inorganic particulate material in position.

Thus, it should be appreciated that one advantage of the method of the present invention may be that a relatively wide range of support materials may be used. For example, where the support material is aluminum or an alloy, a relatively low grade metal could be used compared to the grade of metal usually used for lithographic plates. Additionally and/or alternatively, a metal which is more resistant to, for example developer chemicals, could be used. Furthermore, the method may be used to apply a hydrophilic layer to other types of support materials, for example other metals, foil coated paper and plastics.

A support material nay be pretreated prior to the application of said hydrophilic layer. Where the support material is aluminun or an aluminum alloy, it may be pretreated by one or more conventional methods used in the surface treatment of aluminum, for example caustic etch cleaning, acid cleaning, brush graining, mechanical graining, slurry graining, sand blasting, abrasive cleaning, electrocleaning, solvent degreasing, ultrasonic cleaning, alkali non-etch cleaning, primer coating, grit/shot blasting and electrograining. Details of such methods are provided in: "The surface treatment and finishing of aluminium and its alloys" S. Wernick, R. Pinner and P. G. Sheasby published by Finishing Publication Ltd., ASM International, 5th edition 1987.

Where the support material is pretreated, preferred pretreatments are those which involve adjusting the character of the surface of the support material, for example those involving cleaning, graining or the like. If a surface coating is, however, applied on the surface of the support material, the coating is preferably applied as a liquid.

Preferably, said liquid comprising a silicate solution as described above is applied to a substantially dry surface on said support.

Preferably, said liquid is applied directly onto said support material of said support.

Preferably, the support material is cleaned and/or etched prior to being contacted with said liquid. Cleaning and/or etching may be achieved using an alkaline liquid, for example sodium hydroxide, optionally with additives such as sodium gluconate and/or sorbitol.

The support material may also be subjected to a desmutting treatment, suitably using nitric acid. After this treatment, the support material should be rinsed and/or dried prior to being contacted with said liquid.

The method of preparing a substrate preferably includes the step of adjusting the pH of the surface of the hydrophilic layer formed on said support by contacting the surface with aluminum sulphate so that said hydrophilic layer is compatible with an image layer.

The method preferably includes the step of creating an image layer, suitably directly on said hydrophilic layer, so that the hydrophilic layer is located between the image layer and the support.

The term "image layer" includes a layer that can subsequently be partially removed in order to define areas to be printed and includes a layer which already defines areas to be printed.

The image layer may be provided over the entire surface of said hydrophilic layer. It may comprise any known photosensitive material whether arranged to form a positive or negative plate. Examples of photosensitive materials include diazonium/diazide materials, polymers which undergo depolymerization or addition polymerization and silver halide gelatin assemblies. Examples of suitable materials are disclosed in GB 1 592 281, GB 2 031 442, GB 2 069 164, GB 2 080 964, GB 2 109 573, EP 0 377 589, U.S. Pat. No. 4,268,609 and U.S. Pat. No. 4,567,131. Preferably, the light sensitive material is a quinone diazide material.

Alternatively, said image layer in the form of a desired image for use in planographic printing may be deposited over said hydrophilic layer by a deposition process such as ink jet or laser ablation transfer. An example of the latter is described in U.S. Pat. No. 5,171,650.

Said image layer is preferably arranged over said hydrophilic layer so that formations are defined on the surface of the layer due to formations formed in said hydrophilic layer by particulate material therein. The formations may suitably be arranged to define channels between the light-sensitive layer and a mask so that air can escape from between the layer and the mask in order to decrease the draw-down time of the mask on the layer prior to exposure of the printing plate.

The invention extends to a substrate for a planographic printing member preparable by the method described.

It has been found that a substrate prepared in the method includes a hydrophilic layer which adheres well to the support. Where the support is aluminum or an alloy, this is believed to be due to the formation of aluminum silicate (or at least alumino silicate bonds) on the surface of the support. Thus, the invention suitably provides a substrate wherein chemical bonds are formed between a support material and a hydrophilic layer on the support material. Furthermore, when used in printing, the substrate is found to have wear resistance which is comparable to that of conventional electrograined and anodized substrates.

Preferably, a substrate for a planographic printing plate comprises a support and a hydrophilic layer which includes a binder material derived or derivable from a silicate solution and a particulate material.

Said silicate solution may be as described in any statement herein.

It is believed that said binder material derived from a silicate solution of the type described contains extremely small three-dimensional silicate polymer ions carrying a negative charge. Removal of water from the system as described above causes condensation of silanol groups to form a polymeric structure which includes —Si—O—Si— moieties. Accordingly, the invention extends to a substrate for a planographic printing member comprising a support and a hydrophilic layer which includes a binder material comprising a polymeric structure which includes —Si—O—Si— moieties in which a particulate material is arranged.

Said particulate material may be as described in any statement herein.

Preferably, 30 to 30 wt %, more preferably 40 to 70 wt %, of said hydrophilic layer is composed of said particulate material.

Said particulate material preferably includes a first material as described in any statement herein.

Said first material preferably has a hardness of greater than 8 Modified Mohs (on a scale of 0 to 15), preferably greater than 9 and, more preferably, greater than 10 Modified Mohs.

Said first material in said hydrophilic layer may have a mean particle size and/or particle size distribution as described above for said first material when in said liquid.

Said particulate material on said substrate may include at least 20 wt %, preferably at least 30 wt %, more preferably, at least 40 wt % of said first material.

Said particulate material preferably includes a second material as described in any statement herein.

Said second material in said hydrophilic layer may have a mean particle size and/or particle size distribution as described above for said second material when in said liquid.

Said particulate material on said substrate may include at least 20 wt %, preferably at least 30 wt %, more preferably, at least 40 wt % of said second material.

In the layer, the ratio of the wt % of first material to the wt % of second material may be in the range 0.5 to 2, preferably in the range 0.75 to 1.5, more preferably, about 1 to 1.

Said particulate material may include a third material as described in any statement herein.

Said hydrophilic layer preferably does not include a thermoplastics organic polymeric material, for example polyvinylidene fluoride or the like.

Said hydrophilic layer preferably has an average thickness of less than 20 $\mu$m, preferably less than 10 $\mu$m and, more preferably, less than 5 $\mu$m.

Said hydrophilic layer preferably has an average thickness of greater than 0.1 $\mu$m, preferably greater than 0.3 $\mu$m, more preferably, greater than 0.5 $\mu$m.

Said hydrophilic layer may have an Ra, measured using a stylus measuring instrument (a Hommelmeter T2000) with an LV-50 measuring head, in the range 0.1 to 2 $\mu$m, suitably in the range 0.2 to 2 $\mu$m, preferably in the range 0.2 $\mu$m to 1 $\mu$m, more preferably in the range 0.3 to 0.8 $\mu$m, especially in the range 0.4 to 0.8 $\mu$m.

Said hydrophilic layer may include 1 to 20 g of material per $m^2$ of substrate. Preferably said layer includes 5 to 15 g, more preferably 8 to 12 g, of material per $m^2$ of substrate. Most preferably, said layer includes about 10 g of material per $m^2$.

Said support may comprise any type of support conventionally used for printing members. For example, it may comprise a metal such as aluminum, steel, tin or alloys thereof; paper coated with a metal such as aluminum foil; a plastic material such as polyester; or plastic material coated with a metal. Preferably, the support is aluminum or an alloy.

The method of the present invention can be used to optimize the tensile strength of aluminum by reducing/eliminating annealing of the metal during curing of the hydrophilic layer. Thus, the support of the present invention preferably has a tensile strength of at least 100 MPa, preferably at least 110 MPa and, more preferably, at least 120 MPa. Especially preferred is the case wherein the tensile strength is at least 140 MPa.

Additionally, the method of the present invention may minimize deformation of the support material during support preparation. For example, it is found that, using the method described on an aluminum support, the maximum wave height may only be about 2 mm and the maximum number of waves per meter may be 3.

The invention extends to a planographic printing member comprising a substrate as described above and an image layer over the hydrophilic layer of the substrate.

Preferably, the particulate material in the hydrophilic layer is arranged between the surface of the support and the image layer so that formations are provided on the surface of the image layer as a result of particulate material under the layer.

Said image layer preferably comprises a light sensitive material, a quinone diazide material being preferred.

Any feature of any aspect of an invention described herein may be combined with any feature of any other invention described herein.

The invention will now be described by way of example.

EXAMPLES

Preparation of Lithographic Printing Plate

Example 1

Step 1

Preparation of Aluminum

A 0.3 mm gauge aluminum alloy sheet of designation AA1050 was cut to a size of 230 mm by 350 mm, with the grain running lengthways. The sheet was then immersed face up in a solution of sodium hydroxide dissolved in distilled water (100 g/L) at ambient temperature for 60 seconds and thoroughly rinsed with water.

Step 2

Preparation of Coating Formulation

The following reagents are used in the preparation:

Sodium silicate solution having a ratio $SiO_2$:$Na_2O$ in the range 3.17 to 3.45 (average about 3.3); a composition of 27.1–28.1 wt % $SiO_2$, 8.4–8.8 wt % $Na_2O$, with the balance being water; and a density of about 75 Twaddel (° Tw), equivalent to 39.5 Baumé (° Bé) and a specific gravity of 1.375.

Deionized water having a resistivity of 5 Mohm.cm $Al_2O_3$ powder comprising alumina (99.6%) in the shape of hexagonal platelets. The mean particle size is 3 $\mu$m. The powder has a hardness of 9 Moh (on a 0–10 hardness scale).

Rutile titanium dioxide provided with an inorganic coating of $Al_2O_3$, ZnO and $ZnPO_4$. The mean crystal size is 0.23 $\mu$m.

Deionized water (48 g; 24 wt %) and sodium silicate solution (80 g; 40 wt %) were added to a 250mL beaker and the solution sheared using a Silverson high shear mixer operating at maximum speed. Titanium dioxide powder (36 g; 18 wt %) was then added in portions of approximately 2 g every ten seconds. On completion of the addition, the liquid was sheared for a further two minutes. Then, alumina powder (36 g; 18 wt %) was added in portions of approximately 2 g every ten seconds. On completion of the addition, the liquid was sheared for a further two minutes. The viscosity of the liquid is found to be about 10 centipoise when measured at 20° C. and a shear rate of 200 $s^{-1}$ using a Mettler Rheomat 180 Viscometer incorporating a double gap measuring geometry.

Step 3

Application of Coating Formulation

The coating formulation prepared in Step 2 was coated onto the aluminum sheet prepared in Step 1 using a rotating Meyer bar coater (designation K303) to give a 6 $\mu$m wet film thickness.

Step 4

Drying the Formulation

The coated sheet prepared in Step 3 was placed in an oven at 130° for 80 seconds. The plate was then removed from the oven and allowed to cool to ambient temperature.

Step 5

Post-drying Treatment

The dried sheet prepared in Step 4 was immersed in aluminum sulphate (0.1M) for thirty seconds. The sheet was then spray rinsed for about twenty seconds using tap water and fan dried.

Step 6

Application of Light Sensitive Coating

A printing plate was produced from the sheet prepared in Step 5 by coating, using a Meyer bar, a light sensitive material of the quinone diazide/novolak resin type at a dry coating weight of 2 g/$m^2$. The light sensitive material was dried at 130° C. for 80 seconds.

The printing plate prepared in Step 6 was found to have a comparable performance to commercial printing plates. Advantageously, however, it can be produced at a lower cost.

Example 2

The procedure of Example 1 was generally followed except that a different coating formulation was used in step 2. The formulation was prepared by adding the following components to deionized water (40 wt %) in the order given. After each addition, the formulation was subjected to high shear mixing.

| COMPONENT | WT % |
|---|---|
| Hombitan LW anatase titanium dioxide (mean primary particle size of 0.2 $\mu$m) | 14.2 |
| MICROGRIT ® C3 alumina powder (mean primary particle size of 3 $\mu$m) | 14.2 |
| Sodium silicate solution as in Example 1. | 31.2 |

The printing plate prepared was found to have performance comparable to the plate prepared in Example 1.

Example 3

The procedure of Example 2 was followed except that the following components were mixed in step 2 in the order given below.

| COMPONENT | WT % |
|---|---|
| Deionized water. | 21.51 |
| Hombitan LW anatase titanium dioxide as in Example 2. | 14.15 |
| Alumina powder as in Example 2. | 14.15 |
| Sodium polysilicate solution - having a $SiO_2$ : $Na_2O$ ratio of 5.2 : 1 and containing 22.78% solid. | 50.19 |

The printing plate prepared was found to have a performance comparable to the plate prepared in Example 1.

Example 4

The procedure of Example 2 was followed by mixing the following components in step 2 in the order given below.

| COMPONENT | WT % |
|---|---|
| Deionized water. | 33.29 |
| Hombitan LW anatase titanium dioxide as in Example 2. | 11.83 |
| Alumina powder as in Example 2. | 11.83 |
| BINDZIL ® 15/500 colloidal silica, average particle size 7 nm | 1.1 |
| Sodium polysilicate as in Example 3. | 41.95 |

The printing plate prepared was found to have a performance comparable to the plate prepared in Example 1, except for a slight dye stain of the hydrophilic layer.

Example 5

The procedure of Example 2 was followed by mixing the following components in step 2 in the order given below.

| COMPONENT | WT % |
|---|---|
| Deionized water. | 40 |
| Hombitan LW as in Example 2. | 14.23 |
| Alumina powder as in Example 2. | 13.23 |
| Fabutit 748 aluminum phosphate | 1.0 |
| Sodium silicate as per Example 1. | 31.5 |

The printing plate prepared was found to have a performance comparable to the plate prepared in Example 1.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A method of preparing a substrate for a planographic printing member, the method comprising:

forming a hydrophilic layer on a support by contacting the support with a liquid comprising:

(a) water;

(b) a soluble alkali metal silicate; and (c) a particulate material; in which:

the soluble alkali metal silicate is in solution and the particulate material is dispersed in the liquid;

the molar ratio of $SiO_2$ to $M_2O$, in which M is an alkali metal, in the soluble alkali metal silicate is at least 2.5 and less than 6; and the liquid comprises 5 to 20 wt % of the soluble alkali metal silicate.

2. The method of claim 1 in which the molar ratio of $SiO_2$ to $M_2O$ in the alkali metal silicate is less than 4.

3. The method of claim 2 in which the alkali metal silicate is sodium silicate.

4. The method of claim 3 in which the ratio of $SiO_2$ to $Na_2O$ is in the range of 3.17 to 3.45.

5. The method of claim 2 in which the ratio of the weight of the alkali metal silicate to the weight of the particulate material is 0.1 to 2.

6. The method of claim 2 in which the particulate material comprises a first particulate material that has a hardness greater than 8 Modified Mohs, based on a scale of 1 to 15, and a mean particle size of at least 0.5 $\mu$m to less than 10 $\mu$m.

7. The method of claim 6 in which the particulate material comprises 5 to 40 wt % by weight of the first particulate material.

8. The method of claim 7 in which the first particulate material is alumina.

9. The method of claim 8 in which the ratio of the weight of the alkali metal silicate to the weight of the first particulate material is 0.5 to 1.5.

10. The method of claim 9 in which the alkali metal silicate is sodium silicate.

11. The method of claim 6 in which the particulate material additionally comprises a second particulate material that has a mean particle size of at least 0.001 $\mu$m to less than 10 $\mu$m.

12. The method of claim 11 in which the particulate material comprises 5 to 40% by weight of the second particulate material.

13. The method of claim 12 in which the second particulate material is a pigment.

14. The method of claim 13 in which the second particulate material is titanium dioxide.

15. The method of claim 6 in which the particulate material comprises at least 30% of the first particulate material and at least 30% of the second particulate material.

16. The method of claim 1 in which the liquid comprises 8 to 16 wt % of the alkali metal silicate.

17. The method of claim 16 in which the ratio of the weight of the alkali metal silicate to the weight of the particulate material is 0.2 to 0.6.

18. The method of claim 17 in which the alkali metal silicate is sodium silicate.

19. The method of claim 1 additionally comprising the step of forming an image layer over the hydrophilic layer.

20. The method of claim 1 in which the viscosity of the liquid is less than 100 centipoise.

21. The method of any of claims 1 to 20 in which the support is aluminum or an aluminum alloy.

22. A substrate for a planographic printing member, the substrate comprising a hydrophilic layer on a support;

in which:

the hydrophilic layer comprises a binder material and a particulate material;

the binder material consists essentially of —Si—O—Si bonds; and the substrate is prepared by the method of:

forming the hydrophilic layer on the support by contacting the support with a liquid comprising:

(a) water;

(b) a soluble alkali metal silicate; and (c) a particulate material;

in which:

the soluble alkali metal silicate is in solution and the particulate material is dispersed in the liquid;

the molar ratio of $SiO_2$ to $M_2O$, in which M is an alkali metal, in the soluble alkali metal silicate is at least 2.5 and less than 6; and the liquid comprises 5 to 20 wt % of the soluble alkali metal silicate.

23. The substrate of claim 22 in which the hydrophilic layer has an average thickness of less than 20 $\mu$m.

24. The substrate of claim 22 in which the hydrophilic layer comprises 40 to 70 wt % of the particulate material.

25. The substrate of claim 24 in which the particulate material comprises a first particulate material that has a hardness greater than 8 Modified Mohs, based on a scale of 0 to 15, and a mean particle size of at least 0.5 μm to less than 10 μm, and a second particulate material that has a mean particle size of at least 0.001 μm to less than 10 μm.

26. The substrate of claim 25 in which the first particulate material is alumina and the second particulate material is titanium dioxide.

27. The substrate of claim 26 in which the particulate material comprises at least 30% of the first particulate material and at least 30% of the second particulate material.

28. The substrate of claim 22 in which the alkali metal silicate is sodium silicate, M is Na, and the ratio of $SiO_2$ to $M_2O$ is in the range of 3.17 to 3.45.

29. The substrate of any of claims 22 to 28 additionally comprising an image layer over the hydrophilic layer.

30. The substrate of claim 29 in which the substrate consists essentially of the hydrophilic layer on the support.

31. The substrate of claim 30 in which the support is aluminum or an aluminum alloy.

32. A method of preparing a planographic printing member, the method comprising:

forming a hydrophilic layer on a support by contacting the support with a liquid comprising:

(a) water;

(b) a soluble alkali metal silicate; and (c) a particulate material; and forming an image layer over the hydrophilic layer; in which:

the soluble alkali metal silicate is in solution and the particulate material is dispersed in the liquid; and the molar ratio of $SiO_2$ to $M_2O$, in which M is an alkali metal, in the soluble alkali metal silicate is in the range of 3.17 to 3.45.

33. The method of claim 32 in which the particulate material comprises a first particulate material that has a hardness greater than 8 Modified Mohs, based on a scale of 0 to 15, and a mean particle size of at least 0.5 μm to less than 10 μm and a second particulate material that has a mean particle size of at least 0.001 μm to less than 10 μm.

34. The method of claim 33 in which the alkali metal silicate is sodium silicate.

35. The method of claim 34 in which the support is aluminum or an aluminum alloy.

36. The method of any of claims 32 to 35 in which the image layer comprises a quinone diazide.

37. The method of claim 32 in which the planographic printing member is a planographic printing plate.

* * * * *